United States Patent [19]

Tanaka et al.

[11] 4,145,179

[45] Mar. 20, 1979

[54] COMBUSTION CONTROL SYSTEM

[75] Inventors: Toshio Tanaka, Toride; Sumio Nakagawa, Tokyo; Motosi Miyanaka, Yanai; Seiichi Tachi, Tokyo, all of Japan

[73] Assignee: Hitachi, Ltd., Japan

[21] Appl. No.: 854,641

[22] Filed: Nov. 25, 1977

[30] Foreign Application Priority Data

Nov. 29, 1976 [JP] Japan ..... 51-142301

[51] Int. Cl.[2] ..... F23N 5/00; F23N 5/26

[52] U.S. Cl. ..... 431/29; 431/14; 432/51

[58] Field of Search ..... 431/14, 27, 28, 29, 431/30; 432/51

[56] References Cited

U.S. PATENT DOCUMENTS

| | | | |
|---|---|---|---|
| 3,814,569 | 6/1974 | Jacobsz | 431/29 |
| 3,999,933 | 12/1976 | Murphy | 431/29 |
| 4,035,135 | 7/1977 | Jacobsz | 431/29 |
| 4,078,878 | 3/1978 | Barbour et al. | 431/30 |

*Primary Examiner*—John J. Camby

*Attorney, Agent, or Firm*—Craig & Antonelli

[57] ABSTRACT

A combustion control system applicable universally to various types of combustion apparatus operating with different control timing and different fuel is disclosed. The combustion control system includes a data selector circuit, a control circuit, and a control timer circuit using a counter as timing means. The data selector circuit includes a circuit section for providing pre-purge timing and another circuit section for providing ignition timing as required. The control circuit includes an R-S flip-flop controlled by the pre-purge timing produced by the data selector circuit section.

5 Claims, 5 Drawing Figures

| CONTROL MODE | INPUT | | | TIMING OUTPUT (sec) | | | IGNITION | | RECYCLING UPON FLAME EXTINCTION |
|---|---|---|---|---|---|---|---|---|---|
| | 8 | 7 | 6 | PRE-PURGE | IGNITION | SAFETY | CONTI-NUOUS | DISCON-TINUOUS | |
| A | 0 | 0 | 0 | 4 | 12 | 8 | 0 | | |
| B | 0 | 0 | 1 | 4 | 20 | 8 | 0 | | 0 |
| C | 0 | 1 | 0 | 4 | - | 4 | | 0 | |
| D | 0 | 1 | 1 | 4 | (20) | 4 | | 0 | 0 |
| E | 1 | 0 | 0 | 8 | 8 | 8 | 0 | | |
| F | 1 | 0 | 1 | 8 | 16 | 8 | 0 | | 0 |
| G | 1 | 1 | 0 | 8 | - | 4 | | 0 | |
| H | 1 | 1 | 1 | 8 | (16) | 4 | | 0 | 0 |

COMBUSTION CONTROL SYSTEM

BACKGROUND OF THE INVENTION

1. Field of the Invention

This invention relates to combustion control systems. In particular, this invention relates to a combustion control system of the type including a data selector circuit, a control circuit, and a control timer circuit using a counter as timing means.

2. Description of the Prior Art

Prior art combustion control systems have been designed to operate with individual sequence patterns and timing patterns differing depending on the design of controlled combustion apparatus as each individual combustion apparatus is controlled according to a specific control method and uses a specific fuel to provide a designed thermal output. Thus, a selected type of combustion control system has been used for the combustion control of a specific combustion apparatus. The circuit structure has been such that a CR timer consisting of a resistor and a capacitor is used as a basic element, and many individual parts including transistors and diodes are suitably combined to constitute a specific control system.

Prior art combustion control systems of this kind have thus had different circuit structures and could not be universally used for all the practical applications, since one adapted for the combustion control of a combustion apparatus designed to burn gas has a circuit structure different from that of another adapted for the combustion control of a combustion apparatus designed to burn kerosene. Further, the prior art combustion control systems including so many parts have been defective in that the equipment cost increases inevitably due to the provision of many parts, and an undesirable reduction of the reliability as well as an undesirable increase in the volume of the control system results.

SUMMARY OF THE INVENTION

It is therefore a primary object of the present invention to obviate such defects of the prior art combustion control systems. According to the combustion control system of the present invention, a function switching data selector circuit is connected to its control circuit, and substantial portions of the control system are integrated into an integrated circuit form on a single chip so as to obviate the prior are defects.

DESCRIPTION OF THE PREFERRED EMBODIMENTS

Figure 1:
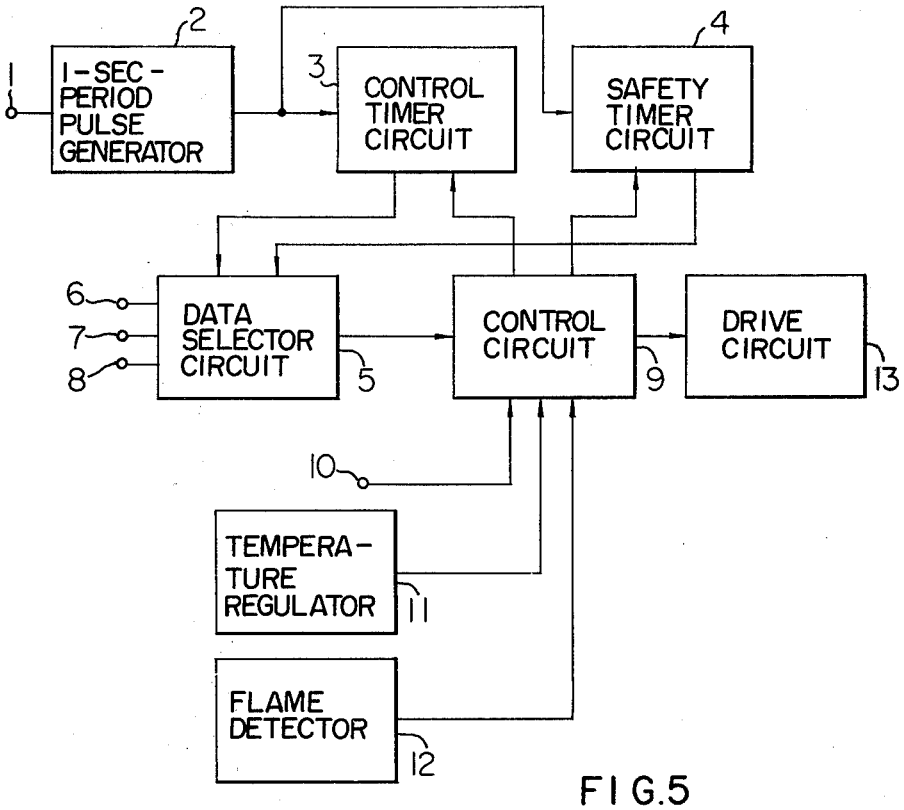
FIG. 1 is a block diagram of a preferred embodiment of the combustion control system according to the present invention.

A preferred embodiment of the combustion control system according to the present invention will now be described with reference to a block diagram shown in FIG. 1. Referring to FIG. 1, a basic clock signal is applied through a clock signal input terminal 1 to a circuit 2 which generates pulses with a predetermined repetition period, for example one second. The circuit 2 is hereinafter referred to as 1-sec-period pulse generator. The output of signal of the circuit 2 is applied to a control timer circuit 3 which provides a pre-purge timing signal and an ignition timing signal. The output signal of the circuit 2 is also applied to a safety timer circuit 4 which provides a safety timing signal to ensure the safety of a controlled combustion apparatus in the event of misfiring or accidental extinction of flame. The output signals of the circuits 3 and 4 are applied to a data selector circuit 5 which selects the control timing and the control mode. A plurality of selector switching signals are also applied to the data selector circuit 5 through respective selector switching signal input terminals 6, 7 and 8. The output signal of the circuit 5 is applied to a control circuit 9 which generates a combustion control signal. A start signal is applied to the circuit 9 through a start signal input terminal 10, and a temperature regulator circuit 11 and a flame detector unit 12 are connected to the circuit 9. The output of the circuit 9 is connected to a drive circuit 13 which drives a plurality of loads (not shown) such as a blower, an ignition unit and a solenoid-operated valve. The arrows in FIG. 1 indicate the flowing directions of various signals.

Figures 2, 3:
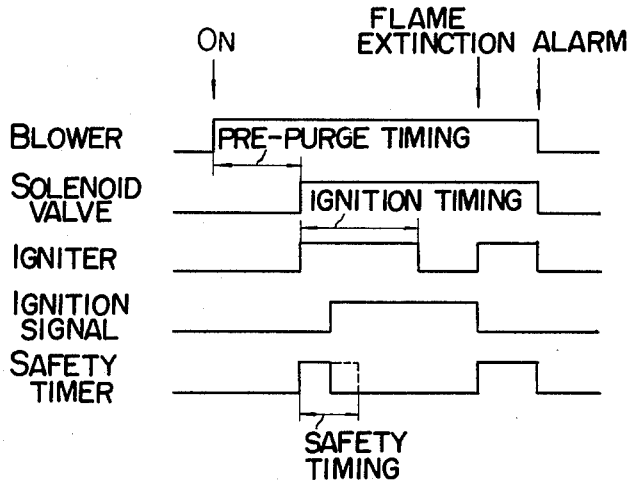
FIG. 2 is a table showing various preferred modes of combustion control according to the present invention.
FIG. 3 is a timing chart illustrating the operation of the combustion control system shown in FIG. 1.

FIG. 2 is a table showing, by way of example, the relation between the selector switching signal inputs applied to the data selector circuit 5 through the input terminals 6, 7 and 8 and the timing signal outputs appearing from the timer circuits 3 and 4 to be applied to the data selector circuit 5 for the purpose of combustion control by the control circuit 9, so that the operation of the system shown in FIG. 1 can be more clearly understood. The pre-purge timing signal provides pre-purge timing of 4 seconds and 8 seconds, and the ignition timing signal provides ignition timing of 8 seconds, 12 seconds, 16 seconds and 20 seconds, while the safety timing signal provides safety timing of 4 seconds and 8 seconds. In various control modes as classified by A to H in FIG. 2, combinations of the selector switching signal imputs of various logic levels provide combinations of the timing signal outputs providing the pre-purge timing, ignition timing and safety timing as shown.

The ignition units are classified into two types operating with a first mode and a second mode respectively. In the ignition unit of the first mode, the igniting operation continues for a predetermined period of time even after the completion of ignition is detected. (This first mode is referred to as a "continuous" mode.) In the ignition unit of the second mode, the ignition unit ceases its igniting operation immediately after the detection of the completion of ignition and repeats its igniting operation upon extinction of the flame in the course of steady combustion. (This second mode is referred to as a "discontinuous" mode.)

In the control modes B and F in FIG. 2, the ignition unit operates with the "continuous" mode, and "recycling" takes place in the event of the detection of extinction of the flame after the lapse of the ignition timing so that the operation of the system is turned back to the original sequence, that is, the step of pre-purge. The term "recycling" applies to the control modes in which the operation of the system is turned back to the step of pre-purge upon the detection of extinction of the flame and does not apply to the control modes in which the operation of the system is turned back to the step of ignition instead of the step of pre-purge. In the control modes A and E, the ignition unit operates with the "continuous" mode, but recycling does not take place in the event of the detection of extinction of the flame. In these control modes A and E, the ignition unit operates with the "continuous" mode within the ignition timing, but operates with the "discontinuous" mode after the lapse of the ignition timing. In the control modes D and H, in which the ignition timing with round brackets is shown, the ignition unit operates with the "discontinuous" mode within the ignition timing, and recycling takes place in the event of the detection of flame extinction after the lapse of the ignition timing. In the control modes C and G, no ignition timing is provided and the ignition unit operates with the "discontinuous" mode.

FIG. 3 shows, by way of example, the control sequence in the case of the control mode A in FIG. 2. In response to the application of the start signal to the start signal input terminal 10, the combustion control system is placed in operation, and the blower is driven for pre-purging the gases remaining in the combustion apparatus. After the pre-purge timing, the electromagnet of solenoid-operated valve and the ignition unit are actuated, and at the same time, the safety timer circuit 4 starts to operate. The safety timer circuit 4 is reset when ignition is completed within the safety timing and the ignition completion signal appears. The ignition unit continues to operate to the end of the ignition timing. When extincition of the flame occurs in the course of combustion after the lapse of the ignition time, the ignition unit is actuated again, and at the same time, the safety timer circuit 4 is also actuated again. When ignition is not attained within the safety timing, the safety timer circuit 4 acts to actuate an alarm unit (not shown) which provides an alarm signal output and stops the operation of the blower, solenoid-operated valve and ignition unit.

Figure 4:
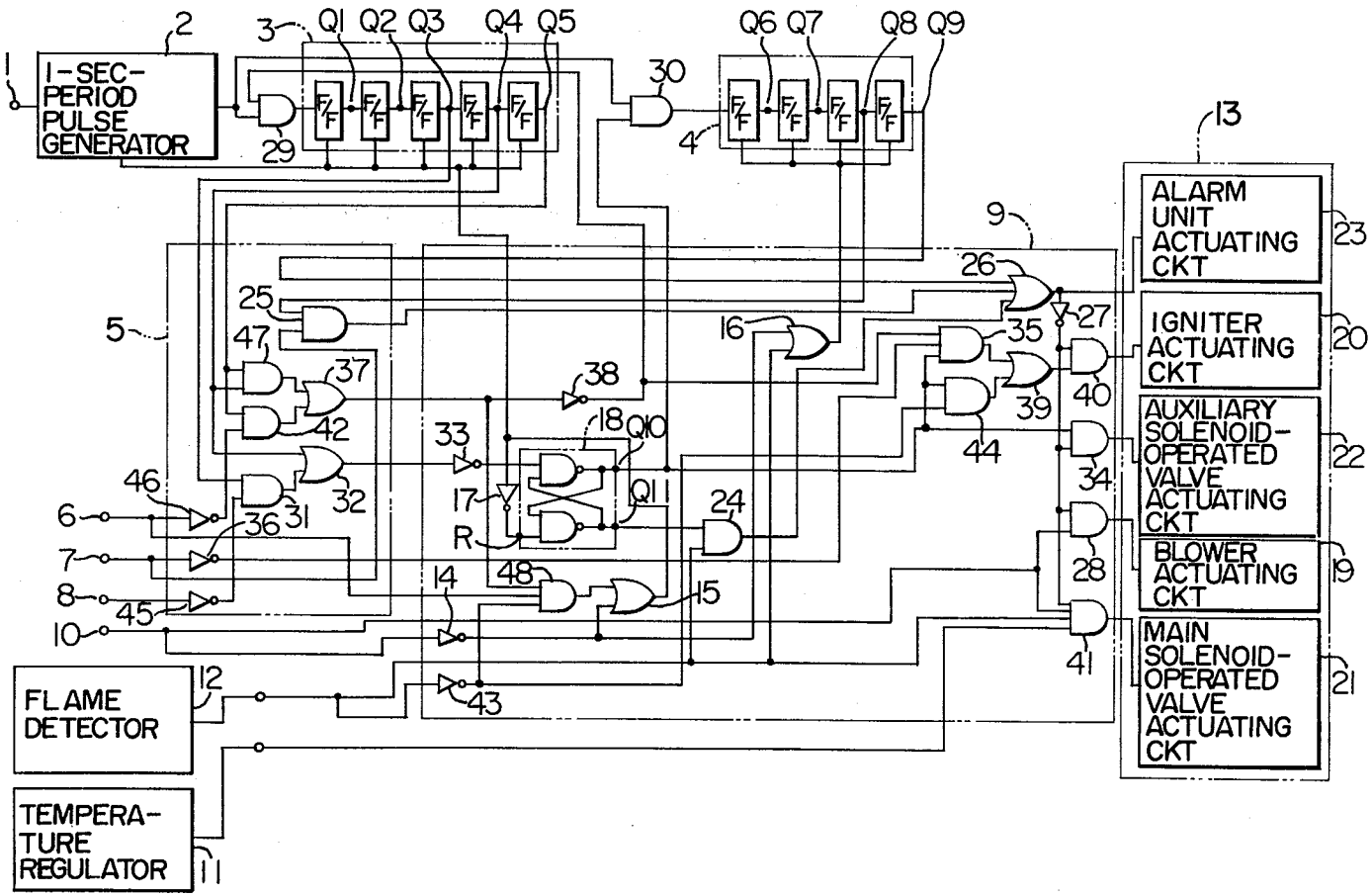
FIG. 4 is a circuit diagram showing a preferred practical circuit structure of the combustion control system of the present invention shown in FIG. 1.

FIG. 4 shows a preferred practical circuit structure of the combustion control system of the present invention having the functions above described. In FIG. 4, the same reference numerals are used to denote the same parts appearing in FIG. 1.

Description will be first directed to the combustion control of a combustion apparatus such as a gas burner apparatus having a pilot burner, which operates in the control mode A in FIG. 2.

In this control mode A, the selector switching signals of logic level "0" are applied to the respective input terminals 6, 7 and 8. The output signal of the flame detector unit 12 is also of logic level "0" before the combustion apparatus is placed in operation. The ouput signal of the temperature regulator circuit 11 is of "1" level to indicate that the combustion apparatus is ready to be placed in operation. The start signal applied to the input terminal 10 is of "0" level before the commencement of the operation of the combustion control system. This start signal of "0" is applied though an inverter 14 to OR gates 15 and 16 so that "1" appears at the output of each of these OR gates 15 and 16. The output signal of the OR gate 15 is applied to the 1-sec-period pulse generating circuit 2 as a reset signal and also to individual flip-flop constituting the control timer circuit 3 as a reset signal. The output signal of the OR gate 16 is applied to individual flip-flops constituting the safety timer circuit 4 as a reset signal. Consequently, the flip-flops constituting the circuits 3 and 4 are reset by the reset signals of "1" level, and "0" appears at each of the outputs $Q_1$ to $Q_9$ of these flip-flops. The 1-sec-period pulse generating circuit 2 is also reset so that no basic pulses or 1-sec-period pulses appear at the output of the circuit 2. The output signal of the OR gate 15 is also connected to an inverter 17, and thus, "0" appears at the output of the inverter 17 to be applied to the reset terminal R of an R-S flip-flop 18. Consequently, "1" appears at the output $Q_{11}$ of the R-S flip-flop 18. Under such a situation, signals of "0" level are applied to a blower actuating circuit 19, an ignition unit actuating circuit 20, a main solenoid-operated valve actuating circuit 21, an auxilliary solenoid-operated valve (for pilot burner) actuating circuit 22 and an alarm unit actuating circuit 23 constituting the drive circuit 13, and "0" appears at the output of each of these circuits 19 to 23, so that the loads connected to these circuits 19 to 23 are not actuated to operate. This state is called a reset state herein. In this reset state, AND gates 24 and 25 provide output signals of "0" level, and an OR gate 26 connected to these AND gates 24 and 25 provides an output signal of "0" level. Therefore, "1" appears at the output of an inverter 27 connected to the OR gate 26.

The start signal of "1" level is applied to the input terminal 10 to place the combustion control system in operation. In response to the application of the start signal of "1" level to the input terminal 10, "1" appears at the output of an AND gate 28 to be applied to the blower actuating circuit 19 thereby actuating the blower connected to this circuit 19. At the same time, the 1-sec-period pulse generating circuit 2, control timer circuit 3, safety timer circuit 4 and R-S flip-flop 18 are released from their reset state, and the 1-sec-period clock pulse signal is applied through an AND gate 29 to the control timer circuit 3 from the 1-sec-period pulse generating circuit 2. This 1-sec-period clock pulse signal is not applied to the safety timer circuit 4 since "0" appearing at the output $Q_{10}$ of the R-S flip-flip 18 is applied to one of the inputs of an AND gate 30 connected between the circuits 2 and 4. In response to the application of the successive output pulses from the 1-sec-period pulse generating circuit 2, the output signals appearing at the outputs $Q_1$, $Q_2$, $Q_3$, $Q_4$ and $Q_5$ of the successive flip-flops constituting the control timer circuit 3 change from "0" to "1" in 1 second, 2 seconds, 4 seconds, 8 seconds 16 seconds respectively, as is commonly known in the art. Similarly, when the output pulses of the circuit 2 are successively applied to the flip-flops constituting the safety timer circuit 4, the output signals appearing at the outputs $Q_6$, $Q_7$, $Q_8$ and $Q_9$ of the successive flip-flops change from "0" to "1" in 1 second, 2 seconds, 4 seconds and 8 seconds respectively.

An AND gate 31 is connected at one of its inputs to the output $Q_3$ of the third flip-flop in the control timer circuit 3 and at the other input to the switching signal input terminal 8 through an inverter 45. Thus, "1" appears at the output of an OR gate 32 connected to the AND gate 31 in 4 seconds corresponding to the pre-purge timing after the application of the start signal to the input terminal 10. Consequently, "0" appears at the output of an inverter 33 connected to the OR gate 32, and the state of the R-S flip-flop 18 is inverted to provide "1" at its output $Q_{10}$ connected to an AND gate 34. The AND gate 34 is opened to pass the output $Q_{10}$ to actuate the auxiliary solenoid-operated valve actuating circuit 22 connected thereto. An AND gate 35 is connected at one of its inputs to the output $Q_{10}$ of the R-S flip-flop 18, at another input to the switching signal input terminal 7 through an inverter 36, and at the remaining input to an OR gate 37 through an inverter 38. At the time at which the auxiliary solenoid-operated valve actuating circuit 22 is actuated, "1" is applied from the output $Q_{10}$ of the R-S flip-flop 18 to the AND gate 35 together with "1" applied from the inverter 36. Since, at this time, the count of the control timer circuit 3 is still not advanced to the last stage, "0" appears from the OR gate 37 connected to an AND gate 47, and "1" appears from the inverter 38 to be applied also to the AND gate 35. Consequently, "1" appears at the output of the AND gate 35 and is applied through an OR gate 39 to an AND gate 40. The input to the ignition unit actuating circuit 20 is now changed from "0" to "1" so that this circuit 20 starts to operate. The AND gate 30 is also opened to permit application of the clock pulses from the circuit 2 to the safety timer circuit 4. Since the selector switching signal applied to the input terminal 7 is of "0" level, the output signal of the AND gate 25 is maintained at its "0" level. As a result of the application of the successive clock pulses to the safety timer circuit 4 from the circuit 2, an output signal of "1" level providing the safety timing of 8 seconds appears from the output $Q_9$ of the circuit 4 to be applied through the OR gate 26 to the alarm unit actuating circuit 23 after the lapse of the safety timing of 8 seconds.

The air, fuel and ignition energy required for combustion are fully provided by the above steps. When the controlled combustion apparatus is normal, the fuel is normally ignited by the ignition unit, and "1" appears at the output of the flame detector unit 12 upon successful ignition. Since the output signal of the temperature regulator circuit 11 is continuously maintained at its "1" level as described hereinbefore, "1" appears at the output of an AND gate 41 to actuate the main solenoid-operated valve actuating circuit 21. Thus, the operating condition of this actuating circuit 21 is determined by the output of the temperature regulator circuit 11. That is, in the gase burner apparatus having the pilot burner, fuel combustion by the main burner is continued and discontinued depending on the output signal of the temperature regulator circuit 11 representing the temperature of, for example, hot water.

The safety timer circuit 4 is reset to produce "0" signal since the output signal of "1" level or reset signal appearing from the flame detector circuit 12 is applied thereto through the OR gate 16. The ignition unit actuating circuit 20 is kept energized by the signal of "1" level applied from the AND gate 35 through the OR gate 39 and AND gate 40 even after the successful ignition of the fuel. At the time at which "1" appears at the output $Q_5$ of the control timer circuit 3 due to the advance of the court, that is, in 16 seconds after the application of the start signal to the input terminal 10, "1" appears at the output of an AND gate 42, and "1" appears at the output of the OR gate 37 connected to the AND gate 42. Consequently, "0" appears at the output of the inverter 38, and "0" appears at the output of the AND gate 35 to stop the operation of the ignition unit actuating circuit 20. The output signal "0" of the inverter 38 is also applied to the AND gate 29 to close this AND gate 29 thereby interrupting the application of the clock pulses from the 1-sec-period clock pulse generating circuit 2 to the control timer circuit 3. The controlled combustion apparatus is placed in the state of steady combustion by the above steps.

Suppose that accidental flame extinction occurs in the course of steady combustion due to system failure. Then, "0" appears at the output of the flame detector unit 12 to be applied through an inverter 43 and an AND gate 44 to the ignition unit actuating circuit 20 to actuate the same again. This output signal "0" of the flame detector unit 12 is also applied through the OR gate 16 to the safety timer circuit 4 to release it from the reset state, and the safety timer circuit 4 starts to count the clock pulses again. When re-ignition of fuel is detected within the safety timing which is 8 seconds in this case, the safety timer circuit 4 is reset and the ignition unit actuating circuit 20 ceases to operate. Conversely, when this re-ignition is not detected within the safety timing of 8 seconds, "1" appears at the output $Q_9$ of the safety timer circuit 4 and is applied through the OR gate 26 to the alarm unit actuating circuit 23 to actuate the same. At the same time, "0" appears at the output of the inverter 27 connected to the OR gate 26, and all the AND gates 28, 34, 40 and 41 are closed or disabled to apply signals of "0" level to the associated actuating circuits 19, 22, 20 and 21 respectively. Thus, the alarm signal is generated, and the blower, solenoid-operated valves and ignition unit cease to operate.

Figure 5:
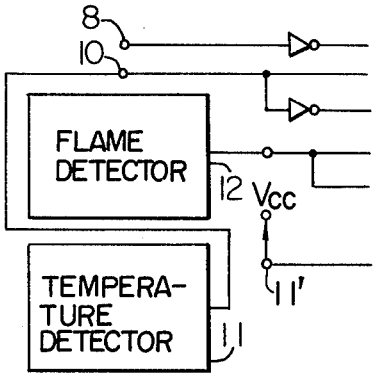
FIG. 5 is a circuit diagram showing a partial modification of the circuit structure shown in FIG. 4.

The above description has referred to an application of the present invention to a controlled apparatus such as a gas burner apparatus having a pilot burner. In an application of the present invention to a controlled apparatus such as an oil burner apparatus not having a pilot burner, the output signal of the temperature regulator circuit 11 may be connected to the start signal input terminal 10 as shown in FIG. 5, and the auxiliary solenoid-operated valve actuating circuit 22 may be used to energize the main solenoid-operated valve. In this case the terminal 11' which has so far received the output of the temperature regulator circuit 11 is preferably connected to a voltage source $V_{cc}$ to be maintained at a logic "1" level always.

Description will be next directed to the combustion control of the combustion system which operates with the control mode E shown in FIG. 2.

In this case, selector switching signals of "0" level, "0" level and "1" level as shown in FIG. 2 are applied to the input terminals 6, 7 and 8 respectively. Due to the application of the selector switching signal of "1" level to the input terminal 8, "0" appears at the output of the inverter 45, and "0" appears at the output of the AND gate 31 thereby altering the pre-purge timing from 4 seconds to 8 seconds. The ignition timing is also altered from 12 seconds to 8 seconds. Except for the above differences, the combustion control system operates generally in the same manner as that described hereinbefore.

Consider then the combustion control according to the control mode C. In this case, selector switching signals of "0" level, "1" level and "0" level are applied to the input terminals 6, 7 and 8 respectively. Due to the application of the selector switching signal of "0" level to the input terminal 8, "1" appears at the output of the inverter 45 to provide the pre-purge timing of 4 seconds. Also, due to the application of the selector switching signal of "1" level to the input terminal 7, "1" appears at the output of the AND gate 25 to provide the safety timing of 4 seconds. The operation of the combustion control system in this control mode C differs slightly from that described with reference to the control mode A. That is, "0" appears at the output of the inverter 36 to maintain the output signal of the AND gate 35 at its "0" level, and the actuating signal for the ignition unit actuating circuit 20 is supplied from the AND gate 44 only. This means that the igniting operation is carried out upon appearance of "1" at the output $Q_{10}$ of the R-S flip-flop 18 due to the termination of the pre-purge timing, and such operation is done each time the output signal of "0" level appears from the flame detector unit 12. That is, the ignition is "discontinuous" in this case.

It will be readily understood that the prepurge timing is extended to 8 seconds in the case of the combustion control according to the control mode G.

The recycling function will be described with reference to the combustion control according to the control mode B. In this case, selector switching signals of "1" level, and "0" level and "0" level are applied to the input terminals 6, 7 and 8 respectively. In this control mode, therefore, the pre-purge timing of 4 seconds is provided. Due to the application of the selector switching signal of "1" level to the input terminal 6, "0" appears at the output of the inverter 46, and the AND gate 42 is not selected. The output signals appearing at the outputs $Q_4$ and $Q_5$ of the control timer circuit 3 are applied to the AND gate 47 to provide the timing of 24 seconds which provides the ignition timing of 20 seconds. Upon termination of the pre-purge timing of 4 seconds followed by confirmation of successful ignition, normal combustion takes place, but the ignition unit actuating circuit 20 continues to operate during the ignition timing of 20 seconds. Upon termination of this ignition timing, the ignition unit ceases to operate.

When "0" appears at the output of the flame detector unit 12 due to system failure in the course of steady combustion, "1" appears at the output of the inverter 43 to open an AND gate 48 since, at this time, the output signal of "1" level appearing from the OR gate 37 and the selector switching signal of "1" level are also simultaneously applied to this AND gate 48. Due to the appearance of "1" at the output of this AND gate 48, "1" appears at the output of the OR gate 15 to reset the control timer circuit 3 and R-S flip-flop 18. This is equivalent to the application of the start signal of "0" level to the input terminal 10, and the combustion control system is restored to the original state to be ready for recycling. Thereafter, "0" appears at the output of the OR gate 37 to release the reset signal applied from the OR gate 15 so that the original sequence is restored for the re-starting of the operation of the combustion control system from the step of pre-purge.

The manner of recycling in the case of the control mode F is generally similar to that above described except for the difference in the pre-purge timing and ignition timing. The control mode D is the combination of the control mode C and the control mode B. The manner of recycling in the case of the control mode H is also generally similar to that in the control mode F except for the difference in the safety timing.

It will thus be seen that the combustion control system according to the present invention is applicable to various types of gas-fired and oil-fired combustion apparatus in which the timing such as the pre-purge timing in one type differs from that in another type due to the difference in the combustion capacity. The combustion control system of the present invention finds universal applications to these combustion apparatus since the levels of the selector switching signals applied to the input terminals 6, 7 and 8 may merely be suitably selected to deal with various control modes as shown in FIG. 2.

In the event of failure of the flame detector unit 12, "1" may appear at the output of the flame detector unit 12 even when no flame is detected. Such failure can be easily detected at the AND gate 24 to which "1" is applied from the output $Q_{11}$ of the R-S flip-flop 18 during the pre-purge timing. This is because, when the flame detector unit 12 is normal, "0" appears always at the output of the AND gate 24, while when the flame detector unit 12 is faulty and "1" appears at the output thereof, "1" appears at the output of the AND gate 24 to be immediately applied to the OR gate 26 connected to the alarm unit actuating circuit 23. The circuit function for ensuring the safety of the combustion apparatus can thus be easily constructed by logic circuit elements.

The digital logic circuit portions except the temperature regulator circuit 11, flame detector unit 12 and drive circuit 13 in FIG. 4 can be very easily integrated into a semiconductor integrated circuit form on a single semiconductor chip. This integration is advantageous in that many functional elements and safety-ensuring elements can be assembled on the semiconductor chip without requiring wiring for interconnection of these elements, thereby greatly reducing the number of parts. Thus, an efficient combustion control system can be obtained which can operate with high reliability and which can be fabricated at low production costs. Further, the combustion control system of the present invention which finds universal applications to various control modes combustion apparatus is advantageous in that the number of component parts to be stored in the factory is reduced to simplify the management of the stock. Integration of the main control parts into the integrated circuit on the single semiconductor chip provides such an additional advantage that the size and weight of the entire combustion control system can be reasonably reduced.

We claim:

1. A combustion control system comprising:

external load drive circuit means including at least a first drive circuit adapted to actuate external pre-purging means for a first predetermined period of time thereby effecting pre-purge of remaining gases prior to the starting of combustion, a second drive circuit adapted to actuate external fuel supply means thereby effecting fuel supply operation, a third drive circuit adapted to actuate external ignition means for a second predetermined period of time thereby effecting ignition of the supplied fuel at a given time, and a fourth drive circuit adapted to actuate external alarm means which acts to generate an alarm signal in the event of failure of successful ignition of fuel within a third predetermined period of time after the effort to ignite the fuel by said ignition means and acts also to interrupt the operation of all the external combustion control means including said pre-purging means, said fuel supply means and said ignition means;

first and second timer circuit means each constituted by a plurality of series-connected frequency-dividing flip-flops counting the number of basic clock pulses applied thereto;

first logic circuit means operating in response to the application of the output signals of said first and second timer circuit means and a plurality of selector switching signals to selectively determine the respective values of said first, second and third predetermined periods of time and the sequential order of the steps of said pre-purge, fuel supply and said ignition in the combustion cycle depending on the application mode of said selector switching signals; and second logic circuit means operating in response to the application of the output signal of said first logic circuit means and external input signals including at least a start signal instructing the commencement of the combustion control and a flame detection signal representing the detected existence of flame to generate a first output signal actuating said first drive circuit thereby actuating said prepurging means at a selected time, a second output signal actuating said second drive circuit thereby actuating said fuel supply means at another selected time, a third output signal actuating said third drive circuit thereby actuating said ignition means at still another selected time, and a fourth output signal actuating said fourth drive circuit thereby actuating said alarm means when said flame detection signal fails to appear within said third predetermined period of time after the application of said third output signal to said third drive circuit.

2. A combustion control system as claimed in claim 1, wherein said second logic circuit means comprises a first logic circuit generating said first output signal in response to the application of the output signal of said first logic circuit means and said external input signals, an R-S flip-flop adapted to be set by said first output signal and reset by said start signal, said R-S flip-flop applying its output signal to said second timer circuit means as a set signal for starting said second timer circuit means, and a second logic circuit adapted to generate said second third output signals in response to the application of the output signal of said R-S flip-flop.

3. A combustion control system as claimed in claim 2, wherein said second logic circuit means comprises a third logic circuit adapted to generate said fourth output signal in response to the application of said output signal of said R-S flip-flop and said flame detecting signal.

4. A combustion control system as claimed in claim 2, wherein said second logic circuit means comprises a fourth logic circuit permitting passage of said start signal to apply it to the reset input terminal of said R-S flip-flop, and said flame detection signal is also applied to said fourth logic circuit besides said start signal so as to control the passage of said start signal through said fourth logic circuit.

5. A combustion control system as claimed in claim 1, wherein said second logic circuit means comprises a first logic circuit adapted to generate said first output signal in response to the application of the output signal of said first logic circuit means and said external input signals, an R-S flip-flop adapted to be set by said first output signal, said R-S flip-flop applying its output signal to said second timer circuit means as a set signal for starting said second timer means, a second logic circuit adapted to generate a signal for resetting said R-S flip-flop and said second timer circuit means in response to the application of said start signal, a third logic circuit adapted to generate said fourth output signal in response to the application of the respective output signals of said R-S flip-flop and said second timer circuit means, and a fourth logic circuit adapted to generate said second and third output signals in response to the application of the respective output signals of said first logic circuit means and said R-S flip-flop.

* * * * *